United States Patent [19]

Stotz

[11] Patent Number: 4,823,690

[45] Date of Patent: Apr. 25, 1989

[54] ROLL CALENDER WITH NIP RELIEVING DEVICES

[75] Inventor: Wolf-Gunter Stotz, Ravensburg, Fed. Rep. of Germany

[73] Assignee: Sulzer-Escher Wyss GmbH, Ravensburg, Fed. Rep. of Germany

[21] Appl. No.: 182,086

[22] Filed: Apr. 15, 1988

[30] Foreign Application Priority Data

Apr. 23, 1987 [DE] Fed. Rep. of Germany ..... 3713561

[51] Int. Cl.[4] ..... B30B 3/04

[52] U.S. Cl. ..... 100/163 A; 100/47; 100/169; 100/170

[58] Field of Search ..... 100/47, 155 R, 161, 100/162 R, 163 R, 163 A, 164, 168, 169, 170, 171, 159; 72/232, 245, 248; 226/152, 189, 190, 194

[56] References Cited

U.S. PATENT DOCUMENTS

| | | | |
|---|---|---|---|
| 3,155,029 | 11/1964 | Thomas | 100/170 |
| 3,183,826 | 5/1965 | Moore et al. | 100/170 X |
| 3,373,681 | 3/1968 | Jaegers | 100/170 X |
| 3,942,434 | 3/1976 | Wenzel et al. | 100/168 |
| 4,510,859 | 4/1985 | Berry | 100/47 X |
| 4,736,678 | 4/1988 | Stotz | 100/163 A |

*Primary Examiner*—Harvey C. Hornsby
*Assistant Examiner*—Stephen F. Gerrity
*Attorney, Agent, or Firm*—Werner W. Kleeman

[57] ABSTRACT

Between an uppermost roll and a lowermost roll there are arranged intermediate rolls mounted with their axles in levers. These levers extend across the width of the roll stand of the calender and are vertically pivotably suspended at a pivot at the roll stand. Nip relieving devices act upon these levers and are supported at a support defining a support location at the roll stand. Each pivot is arranged at an associated bearing element which is elevationally adjustable and which is located at the rear side of the roll stand remote from the rolls. If the position of the intermediate rolls change in vertical direction, the related bearing elements are correspondingly individually and vertically displaced, so that the levers are brought into an essentially horizontal position at which the axles of the intermediate rolls and the pivots of the related levers are located in each case in a related horizontal plane. An advantageous construction has the bearing element vertically displaced along a guide by rotating a threaded spindle, to which the bearing element is individually engagable by a coupling device.

12 Claims, 1 Drawing Sheet

ROLL CALENDER WITH NIP RELIEVING DEVICES

CROSS-REFERENCE TO RELATED APPLICATION

This application is related to the commonly assigned, co-pending U.S. patent application, Ser. No. 176,292, filed 3/31/88, and entitled "APPARATUS FOR GUIDING THE ROLLS OF AN ESSENTIALLY VERTICALLY CALENDER".

BACKGROUND OF THE INVENTION

The present invention relates to a new and improved construction of a roll calender with nip relieving devices.

Generally speaking, the roll calender with nip relieving devices of the present development is of the type in which intermediate rolls arranged between an uppermost roll and a lowermost roll are mounted with their axles or shafts at levers or lever members. These levers extend across the width of the roll stand and are elevationally, namely essentially vertically pivotably suspended at a pivot or pivot pin or the like at the roll stand. Nip relieving devices act at these levers. These nip relieving devices are also supported at the roll stand at an associated support defining a support location.

Such a roll calender is described, for example, in the European Patent Application No. 86116695.7, published under European Published Application No. 0,230,563, on Aug. 5, 1987 and the cognate U.S. Pat. No. 4,736,678, granted Apr. 12, 1988. Because of the pendulum suspension provided for the levers of the intermediate rolls, these intermediate rolls of this roll calender can assume without obstruction, under the action of the contact pressure, an elevational position which, in each case, corresponds to the actual roll diameter. This roll diameter changes with the wear of the related roll. This is also the case when one or several worn rolls are replaced by new rolls possessing a larger diameter. With the pendulum suspension of the rolls, the vertical displacement of the rolls is accomplished, however, along a circular line or arc with the center thereof at the pivot or fulcrum pin of the related lever. Hence, the situation can arise that the axles or shafts of the individual rolls of the roll calender do not lie in a common vertical plane. Such a situation is not desired.

SUMMARY OF THE INVENTION

Therefore, with the foregoing in mind, it is a primary object of the present invention to provide a new and improved roll calender with nip relieving devices which does not exhibit the aforementioned shortcomings of the prior art.

A further important object of the present invention aims at obviating the aforementioned shortcomings and, in particular, devising an improved roll calender with nip relieving devices, such that the axles or shafts of the rolls of the roll calender lie in a common vertical plane when the elevation position of the individual rolls is changed.

Now in order to implement these and further objects of the invention, which will become more readily apparent as the description proceeds, the roll calender with nip relieving devices of the present invention is manifested, among other things, by the features that a respective bearing element or part, at which the pivot or pivot pin of the associated lever or lever member is located, is arranged to be elevationally adjustable at the rear side of the roll stand. This rear side is located remote from the calender rolls. Upon changing the position of the rolls in vertical direction or sense, and upon appropriately individually altering the position of the associated bearing elements or parts, the related lever can be adjusted or positioned to assume an essentially horizontal position in which the axles or shafts of the rolls and the pivots or pivot pins of the levers each lie in a related substantially horizontal plane.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that in order to simplify the illustration thereof, only enough of the construction of the inventive roll calender with nip relieving devices has been shown as is needed for those skilled in the art to readily understand the underlying principles and concepts of the present development. It is also to be observed that since essentially similar structure is provided at the opposite side of the roll calender from that shown in FIG. 1, it will suffice to consider details of the structure depicted at the one depicted side of the roll calender as illustrated in FIG. 1.

Figure 1:
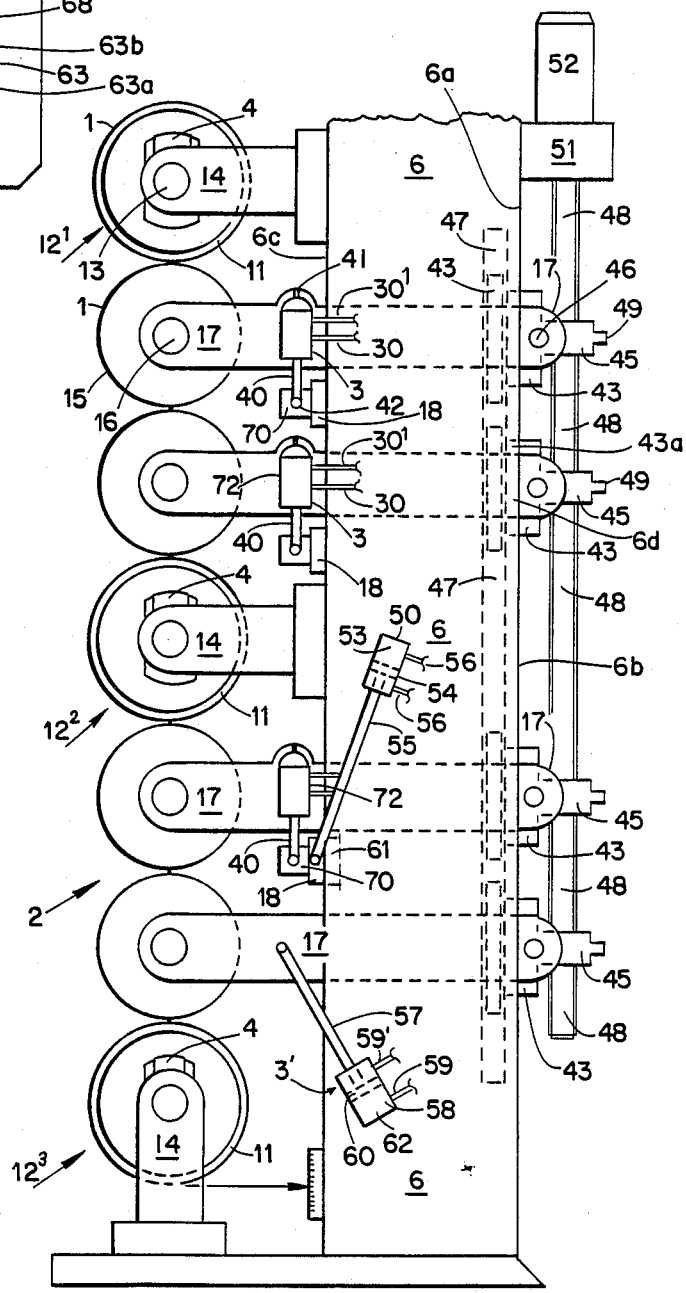
FIG. 1 schematically illustrates in side view a roll calender constructed according to the teachings of the present invention.

Turning now to the drawings and specifically to FIG. 1, the therein depicted exemplary embodiment of roll calender 2 will be seen to comprise, for instance, seven rolls of a roll stack arranged at a roll stand 6 in such roll calender 2. In the depicted roll stack or set of this roll calender 2 there are provided as concerns certain of the rolls, three controlled deflection rolls $\mathbf{12}^1$, $\mathbf{12}^2$ and $\mathbf{12}^3$ containing roll shells or jackets 11 which are freely movable in a predeterminate pressing direction. In the illustrated arrangement the controlled deflection roll $\mathbf{12}^1$ constitutes the uppermost roll, the controlled deflection roll $\mathbf{12}^3$ the lowermost roll, and the controlled deflection roll $\mathbf{12}^2$ the intermediate roll of the roll stack or set. These controlled deflection rolls $\mathbf{12}^1$, $\mathbf{12}^2$ and $\mathbf{12}^3$ are each mounted at their opposite ends at an associated lever-like support member 14. Each roll shell or jacket 11 is mounted on support or pressure elements 4 arranged between such roll shell or jacket 11 and the related stationary carrier or beam, as is well known in this art.

As to the other intermediate four rolls 15, exclusive of the intermediate controlled deflection roll $\mathbf{12}^2$, arranged between the uppermost controlled deflection roll $\mathbf{12}^1$ and the lowermost controlled deflection roll $\mathbf{12}^3$, the roll surfaces 1 are constituted by the outer or circumferential surfaces of the individual intermediate rolls 15 of the roll calender 2. These intermediate rolls 15 are mounted at opposite ends with their axles or shafts 16 at a related elongated lever or lever member 17. These levers or lever members 17 extend as far as appropriate across the width of the roll stand 6 of the roll calender 2 and are elevationally, namely vertically pivotably suspended at that location at a related pivot or fulcrum or pivot pin 46. It is advantageous if the elongated levers or lever members 17 are as long as possible.

Nip relieving devices 3 engage with these levers or lever members 17. These nip relieving devices 3 are not only supported at the levers 17 but are also supported at support devices or supports 70 defining support locations or points 42 at the roll stand 6. As is well known in this art, these nip relieving devices 3 serve to compensate for the so-called overhanging weights or loads and are additionally able to raise the associated levers or lever members 17 together with their associated intermediate rolls 15 or to lower such intermediate rolls 15 so as to assume a predeterminate roll position. In the embodiment according to FIG. 1, the nip relieving devices 3 are preferably constituted by piston-and-cylinder devices or units 72 which can be connected via fluid flow or supply lines or conduits 30 and 30' with a not particularly illustrated but conventional source of fluid medium, such as hydraulic pressure medium or pressure gas which is at a suitable pressure.

The pivot pin 46 or equivalent structure of each associated lever or lever member 17 is located at an associated bearing element or part 43. Each such bearing element 43 or the like is elevationally, namely, vertically adjustably arranged at the rear side or end region 6*a* of the roll stand 6. This rear side 6*a* is located remote from the intermediate rolls 15. Each bearing element or part 43 is individually elevationally or vertically adjustable, so that at each assumed elevational or vertical position of the related intermediate roll 15 it is possible to correspondingly position the associated bearing element or part 43 such that the lever or lever member 17 is set or postured in a substantially horizontal position or is in a position in which the axles or shafts 16 of the related intermediate roll 15 and the axis of each pivot or fulcrum pin 46 lie essentially in a horizontal plane. When such adjustment or setting of the intermediate rolls 15 is accomplished at the roll calender 2, then all of the axles or shafts of the rolls and all of the pivot pins or pivots 46 are located in mutually parallel substantially horizontal planes.

The roll stand 6 advantageously comprises on the side remote from the intermediate rolls 15 a substantially vertical or upright slide guide or guide 47 in which the appropriately structured bearing elements or parts 43 are displaceable and lockable. It is also to be understood that the slide guide or guide 47 and the thereto complementarily constructed sliding parts 43*a* of each associated bearing element or part 43 are structured such that the bearing elements 43 can slide along and be guided by the slide guide or guide 47 without there arising any jamming.

The bearing elements or parts 43 each comprise a bearing sleeve or sleeve member 45 through which piercingly extends a threaded spindle or spindle member 48. This threaded spindle 48 is arranged essentially parallel to the slide guide or guide 47 and is rotatable by means of a suitable drive motor 52 provided with gearing or transmission unit 51 and which is mounted at the roll stand 6. The threaded spindle 48 extends through all of the bearing sleeves or sleeve members 45 of the bearing elements or parts 43. At each bearing sleeve 45 there is provided a coupling or coupling device 49 in order to be able to individually engage each bearing element or part 43 with the threaded spindle 48 such that there can be accomplished a desired displacement of the individually engaged bearing part or element 43 or, as the case may be, to disengage such bearing element or part 43 from the threaded spindle 48 upon reaching a desired position of the bearing element or part 43. A more detailed description of this function and of the elements required for this purpose will follow hereinbelow.

It is likewise necessary to positionally adapt the supports or support members 70 for the nip relieving devices 3 at the roll stand 6 to the changing positions of the intermediate rolls 15 mounted at the pendulum-movable levers or lever members 17. It is advantageous if each nip relieving device 3 engages with the related or associated lever or lever member 17 as near as possible to the related or associated intermediate roll 15, or, stated in a different way, as far as possible from the related pivot or pivot pin 46 of the lever or lever member 17. According to an exemplary embodiment thrice shown in FIG. 1 of the drawings, the nip relieving devices 3 are typically all constructed in the same manner. In other words, in each case these nip relieving devices have the same total displacement path or stroke within which all functions of each nip relieving device 3 must be ensured. If, upon changing the position of a lever or lever member 17, the lever position should lie beyond the total displacement path or stroke, then the corresponding support member 70 defining the associated support point or location 42 arranged at an associated support member 18 must be correspondingly displaced. According to the construction shown in the drawings by way of example, this is accomplished by displacement of the displaceable support member 18 along a guideway or guide 61 provided at the roll stand 6. This guideway 61 or equivalent guiding facility, which is disposed substantially vertically and parallel to the slide guide or guide 47 at the roll stand 6, is schematically indicated in FIG. 1 of the drawings.

The displacement of the support member 18 is here achieved by means of an adjustment or positioning motor 53 which, on the one hand, is secured at the roll stand 6 and, on the other hand, engages with the associated support member 18, as shown in FIG. 1. In the depicted embodiment the adjustment motor 53 is, for instance, a hydraulic motor 50, 54 comprising a cylinder 50 provided therein with a reciprocatable piston 54, and the piston rod 55 of such piston 54 acts at the associated support member 18. A suitable pressure or pressurized medium is appropriately fed via lines or conduits 56 or 56' to the adjustment motor 53. For the sake of simplification, only one such adjustment motor 53 is illustrated in the drawings but it will be evident and understood that similar structure may be provided, as desired, for other ones of the intermediate rolls 15.

According to another exemplary embodiment of the invention, likewise illustrated in FIG. 1, the nip relieving device 3' comprises a hydraulic adjustment motor 58 containing a cylinder 62, a piston 60 and a piston rod 57. This piston rod 57 directly engages with the associated lever or lever member 17. A suitable pressure or pressurized medium is fed via lines or conduits 59 or 59' to the adjustment motor 58. In this case, the adjustment motor 58 must be structured in such a manner that the possible total displacement path or stroke of the piston or piston member 60 must be designed in accordance with the contemplated ascending and descending displacement path or stroke for nip relieving as well as in accordance with the possible positions of the related intermediate roll 15 upon change of its diameter, in other words, in accordance with the displacement of the associated intermediate roll 15. In a specific case, there are used rather long cylinders having a rather long possible total displacement path or stroke which, however, during their momentary operation utilize only a small portion of such total displacement path or stroke. For the sake of simplicity, only one adjustment or positioning motor 58 is shown in FIG. 1 at the lower portion thereof and which there acts from below at the associated lever or lever member 17. It should be understood, however, that the remaining levers or lever members 17 are likewise movable by an adjustment or positioning motor, such as the adjustment motor 58, and such further adjustment motors can also act upon the levers or lever members 17 from above.

It will be further evident from the drawings that certain problems could arise as concerns the available space for the hereinbefore described adjustment or positioning motors 53 or 58.

For that reason, the roll stand 6 advantageously comprises, in a horizontal section, a substantially U-shaped profile or configuration, generally indicated by reference character **6*b*, which is open on the side 6*c* facing the intermediate rolls 15. The levers or lever members 17 are arranged in the hollow substantially U-shaped profile 6*b*, and the adjustment motors 53 or 58, as the case may be, the support members 18 and the bearing elements or parts 43 can be arranged outside or beyond this hollow space. This of course does not exclude an arrangement in which the levers or lever members 17 are arranged externally at the roll stand 6. However, it is conceivable that in case of space problems the adjustment motors possibly can be arranged in alternate sequence outside the hollow space as well as within the hollow space of the roll stand 6**.

On the rear side **6*a* of the substantially U-shaped profile 6*b* facing away from the intermediate rolls 15 there are provided openings 6*d* for the reception of the levers or lever members 17; the vertical slide guide or guide 47 and the bearing elements or parts 43 are also arranged at this location. The bearing sleeve or sleeve member 45 and thus also the bearing element or part 43 is supported in each case at an externally toothed nut or nut member 63. This externally toothed nut 63 is provided with an internal screw thread 63*a* complementary to or corresponding with the threading or threads 48*a* of the threaded spindle 48 and is displaceable along the threaded spindle 48 during rotation of the latter as to be explained below. In this manner the bearing element or part 43** is also displaced.

A coupling or coupling device 49 is provided for individually selectively engaging and disengaging the externally toothed nut 63 with the threaded spindle 48.

Figure 2:
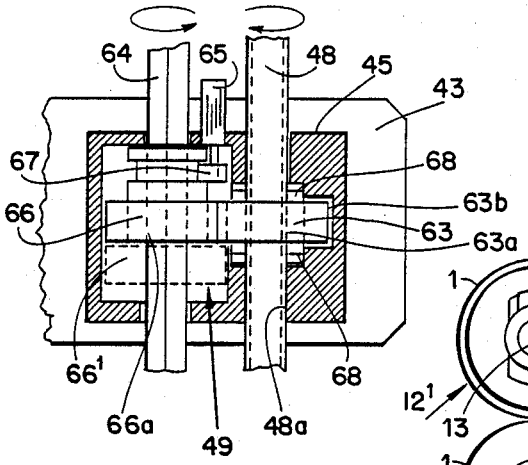
FIG. 2 illustrates in vertical partial sectional view, on an enlarged scale, a bearing element or part provided with a bearing sleeve.

An advantageous embodiment of such a coupling or coupling device is particularly shown in FIG. 2.

The threaded spindle 48 extends through the bearing sleeve 45. The externally toothed nut 63, possessing the internal screw thread **63*a* conforming with the threads 48*a* of the threaded spindle 48, is seated on such threaded spindle 48. The bearing sleeve 45 is supported at the externally toothed nut 63 by means of a thrust or pressure bearing structure 68. A traction or draw spindle 64 likewise extends through the bearing sleeve or sleeve member 45. In the embodiment under discussion, this traction or draw spindle 64 comprises a spline rod 64*a* which is rotatable by the drive motor 52 and the gearing unit 51 in a direction of rotation which is opposite to that of the threaded spindle 48 and, for example, with the same rotational speed. A gear wheel or gear 66 meshing with the externally toothed nut 63 is located at the traction or draw spindle 64. This gear wheel 66 possesses a central spline bore 66*a* which conforms with the profile of the traction spindle 64 and is displaceable along the traction spindle 64, namely from a position in which the gear wheel or gear 66 meshes with the lines by reference numeral 66', where such gear wheel or gear 66 is disengaged from the externally toothed nut 63. This displacement of the gear wheel or gear 66 is carried out by means of a guide block or element 67 which engages with the coupling device 49 and is displaceable by an adjustment motor 65 or the like. This guide block 67 is structured as a locking or blocking tooth, such that in the depicted embodiment it can be displaced downwardly to mesh with the external toothing or teeth 63*b* of the externally toothed nut 63** and to block the latter from rotating.

The described coupling device 49 functions as hereinafter disclosed.

When the externally toothed nut 63 is in mesh with the gear wheel or gear 66, then the externally toothed nut 63 rotates with the same rotation speed and in the same sense of rotation as the threaded spindle 48. In other words, under these circumstances the externally toothed nut 63 is not displaced along the threaded spindle 48. The bearing sleeve 45 with the bearing element or part 43 are stationary. However, if the gear wheel 66 is moved by the action of the adjustment or positioning motor 65 away from the externally toothed nut 63 and into the position 66' and thus disengaged from the externally toothed nut 63, then this externally toothed nut 63 remains stationary in relation to the rotating threaded spindle 48, since the guide block or element 67 defining the locking tooth 67 now meshes with the external toothing or teeth **63*b* of the externally toothed nut 63 and blocks the latter from rotating. The externally toothed nut 63 now travels along the threaded spindle 48 and the bearing element or part 43** is thus displaced in relation thereto.

The adjustment motor 65 is for instance, as shown, a pneumatic cylinder-piston motor. This adjustment motor 65 also could be, for example, constituted by an electromagnetic motor or an equivalent adjustment facility.

The threaded spindle 48 and the traction spindle 64 also could rotate with mutually different speeds. This then would indeed have to be taken into account by the number of teeth of the externally toothed nut 63 and the gear wheel or gear 66.

While there are shown and described present preferred embodiments of the invention, it is to be distinctly understood that the invention is not limited thereto, but may be otherwise variously embodied and practiced within the scope of the following claims.

Accordingly, what I claim is:

1. A roll calender, comprising:

a roll stand having a predeterminate width and a rear side;

a plurality of superimposed rolls;

a lowermost roll defining one roll of said plurality of superimposed rolls;

an uppermost roll defining another roll of said plurality of superimposed rolls;

intermediate rolls defining rolls of said plurality of superimposed rolls and arranged between said lowermost roll and said uppermost roll;

at least predeterminate ones of said intermediate rolls each having an axle;

a lever provided for the axle of each of said predeterminate ones of said intermediate rolls;

pivot means provided at said roll stand for each said lever;

each said axle being supported by an associated one of said levers;

each said lever extending across the predeterminate width of said roll stand and being substantially vertically pivotably suspended by an associated pivot means at said roll stand;

a nip relieving device acting upon each of said levers;

means defining a support location for each nip relieving device;

each of the nip relieving devices being supported at said roll stand at an associated one of said support locations;

a respective bearing element provided for each lever and provided with an associated one of said pivot means;

means for substantially vertically adjustably positioning the bearing elements at the rear side of said roll stand;

said rear side of the roll stand being located remote from said intermediate rolls; and each said bearing element being substantially vertically adjustable such that upon changing the position of at least given ones of said predeterminate ones of said intermediate rolls, each said lever can be set in a substantially horizontal position by accomplishing a predeterminate individual displacement of the associated bearing element thereof and in which substantially horizontal position said axles of said predeterminate ones of said intermediate rolls and said pivot means of said associated levers lie in respective substantially horizontal planes.

2. The roll calender as defined in claim 1, wherein:

said roll stand comprises a substantially vertical guide in which there are displaceable and lockable said bearing elements and defining at least part of said substantially vertically adjustably positioning means.

3. The roll calender as defined in claim 2, wherein:

said substantially vertically adjustably positioning means comprises:

a bearing sleeve provided for each said bearing element;

a motor;

gearing means provided for said motor;

a threaded spindle extending through said bearing sleeves of the bearing elements;

said threaded spindle being rotated by said motor by means of said gearing means;

a coupling device provided for each said bearing sleeve; and each said coupling device serving to individually engage the associated bearing element with said threaded spindle in order to displace said associated bearing element.

4. The roll calender as defined in claim 3, further including:

a guideway provided at said roll stand;

support means provided for each nip relieving device and displaceable along said guideway; and said means defining a support location for the nip relieving devices being located at an associated one of said support means.

5. The roll calender as defined in claim 4, further including:

an adjustment motor provided for each support means;

each said adjustment motor being secured at said roll stand and at an associated one of said support means; and each said support means being displaceable by means of the associated adjustment motor along the guideway.

6. The roll calender as defined in claim 5, wherein:

said adjustment motor comprises a hydraulic motor containing a piston-and-cylinder unit;

said piston-and-cylinder unit including a piston rod; and said piston rod acting at the associated support means.

7. The roll calender as defined in claim 3, wherein:

each nip relieving device comprises a hydraulic motor;

each said hydraulic motor comprising a cylinder, a piston and a piston rod;

said piston rod directly acting at the associated lever;

each said cylinder being mounted at said roll stand;

each piston having a predeterminate displacement path within the associated cylinder thereof; and the predeterminate displacement path of said piston within said associated cylinder being dimensioned such that a predeterminate possible total displacement path of said piston corresponds to ascending and descending displacement paths of the associated intermediate roll contemplated during nip relieving as well as to a required total displacement path of the associated intermediate roll upon change of diameter of said associated intermediate roll.

8. The roll calender as defined in claim 7, wherein:

said roll stand possesses a substantially U-shaped profile when viewed in horizontal section;

said substantially U-shaped profile being open on a side facing said intermediate rolls and defining a hollow space;

said levers extending through said hollow space of said substantially U-shaped profile; and said adjustment motors, said support means and said bearing elements being arranged externally of said hollow space.

9. The roll calender as defined in claim 3, wherein:

each said coupling device comprises an externally toothed nut provided with an internal screw thread;

said threaded spindle having threading;

said internal screw thread meshing with said threading of said threaded spindle; and said bearing sleeve being supported by said externally toothed nut and being displaceable along said threaded spindle during rotation of said threaded spindle.

10. The roll calender as defined in claim 9, wherein:

each said coupling device is provided for an associated one of said externally toothed nuts;

each externally toothed nut having external threading;

a traction spindle arranged substantially parallel to said threaded spindle and drivable in a direction of rotation which is opposite to that of said threaded spindle;

each said coupling device comprising a gear wheel possessing the same external toothing as said externally toothed nut;

said gear wheel being arranged at said traction spindle and being displaceable in relation to said externally toothed nut; and means for selectively displacing said gear wheel such that said gear wheel can assume either one of two positions, wherein the gear wheel in one position meshes with said externally toothed nut and in the other position is disengaged from said externally toothed nut.

11. The roll calender as defined in claim 10, wherein:

said selectively displacing means comprises for each coupling device a locking tooth which is supported at the associated bearing sleeve and upon disengagement of said gear wheel projects into the external toothing of the associated externally toothed nut to thus prevent rotation of said externally toothed nut.

12. A roll calender, comprising:

a roll stand;

at least one roll defining an intermediate roll;

said intermediate roll having an axle;

a lever provided for the axle of said intermediate roll;

pivot means provided at said roll stand for said lever;

said axle being supported by said lever;

said lever being substantially vertically pivotably suspended by said pivot means at said roll stand;

a nip relieving device for selectively controlling the position of said lever;

means for supporting said nip relieving device at the roll stand;

a bearing element provided for said lever and provided with said pivot means;

means for substantially vertically adjustably displacing the bearing element at said roll stand; and said bearing element being substantially vertically adjustable such that upon changing the position of said intermediate roll said lever can be set in a substantially horizontal position by accomplishing a predeterminate displacement of the bearing element and in which substantially horizontal position said axle of said intermediate roll and said pivot means of said lever lie in a substantially horizontal plane.

* * * * *